United States Patent [19]

Lubniewski et al.

[11] Patent Number: 4,476,806

[45] Date of Patent: Oct. 16, 1984

[54] WET FILM APPLICATOR

[75] Inventors: Stephen E. Lubniewski, Endicott; Christian Haggenmiller, Owego, both of N.Y.

[73] Assignee: The United States of America as represented by the Secretary of the Air Force, Washington, D.C.

[21] Appl. No.: 413,297

[22] Filed: Aug. 31, 1982

[51] Int. Cl.[3] ..... B05C 17/02

[52] U.S. Cl. ..... 118/110; 118/102; 118/120; 118/414; 29/110.5; 29/121.6

[58] Field of Search ..... 118/258, 414, 415, 413, 118/110, 120, 102, 100; 29/121.6, 121.7, 110.5; 100/210; 15/210.5; 30/307, 319

[56] References Cited

U.S. PATENT DOCUMENTS

| | | | |
|---|---|---|---|
| 632,059 | 8/1889 | McCreery | 29/121.6 X |
| 1,441,920 | 1/1923 | Gsjalder | 118/102 |
| 2,066,780 | 1/1937 | Holt | 118/414 X |
| 2,992,941 | 7/1961 | Whitley et al. | 117/102 |
| 3,131,104 | 4/1964 | Korn | 29/110.5 X |
| 3,301,699 | 1/1967 | Mozzi | 117/111 |
| 3,335,696 | 8/1967 | Faltin et al. | 118/5 |
| 3,431,616 | 3/1969 | Lewis | 30/319 X |
| 3,535,157 | 10/1970 | Steinhoff et al. | 117/212 |
| 3,653,338 | 4/1972 | Sauey | 29/110.5 X |
| 3,718,117 | 2/1973 | Lewicki, Jr. | 118/414 |
| 3,994,652 | 11/1976 | Kuzyk | 30/307 X |
| 4,354,810 | 10/1982 | Stidham | 118/120 X |
| 4,361,085 | 11/1982 | Schutz | 29/121.6 X |

*Primary Examiner*—John P. McIntosh

*Attorney, Agent, or Firm*—Donald J. Singer; Stanton E. Collier

[57] ABSTRACT

A manually-operated applicator for use in applying a film of wet material in a preselected, uniform, initial wet film thickness on the top flat surface of a workpiece which is in a level position. The applicator comprises a cylindrical rod having a plurality of equally spaced-apart, annularly-shaped protrusions which form contact surfaces with the wet material and with the surface of the workpiece. The protrusions extend from the circumferential surface of the applicator a distance equal to the desired uniform thickness of the wet film. The wet material is manually rolled or pushed or pulled with the applicator by the user until the wet material covers the surface of the workpiece in its entirety, and until the top surface of the wet film is flush and level with the contacting circumferential surface of the applicator.

1 Claim, 4 Drawing Figures

FIG. 3
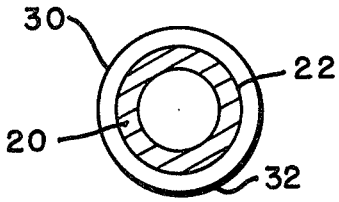
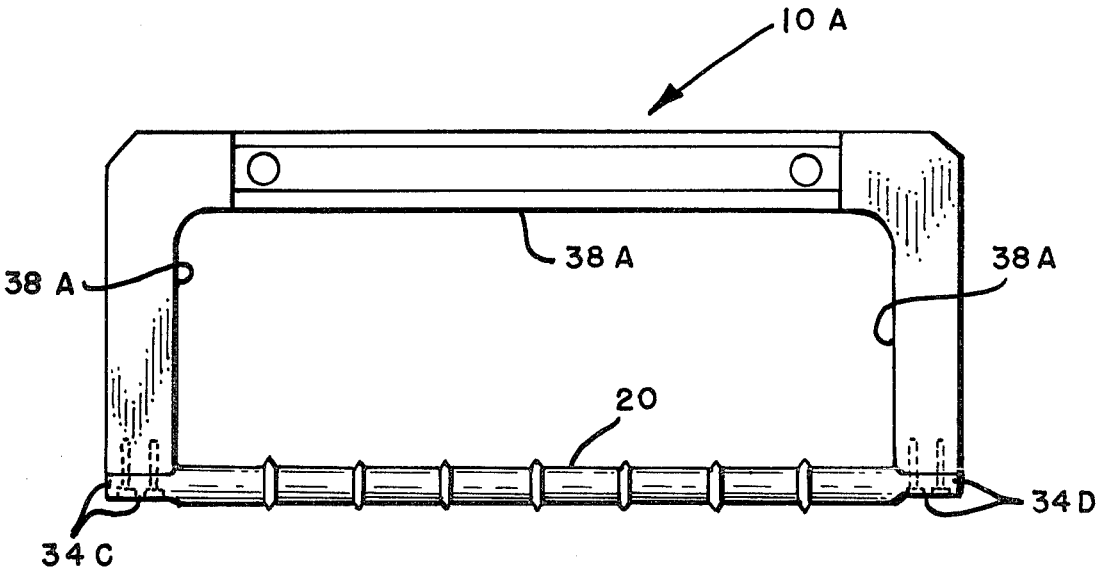
FIG. 4

WET FILM APPLICATOR

STATEMENT OF GOVERNMENT INTEREST

The invention described herein may be manufactured and used by or for the Government for governmental purposes without the payment of any royalty thereon.

BACKGROUND OF THE INVENTION

The instant invention relates to a material applicator and more particularly to an applicator for applying an initially wet film of a material at a preselected uniform thickness on a flat surface of a workpiece which is in a level position.

The application of initially "wet" materials (such as adhesives, paints, inks, resinous compositions, and the like) has always been troublsome in the prior art. Before the advent of the instant invention, the attempt to coat a surface with any wet material could result in: a coating (i.e., layer, or film) of non-uniform (i.e., uneven) thickness; the attained thickness of the coating not meeting the required preselected thickness (i.e., too thick, or too thin); and other defects which could result in rejection of the entire workpiece because of the non-acceptable coated surface. In addition, spillage and waste of the wet material, and irritability, frustration, and consequent inefficiency of the human applier, caused by the required constant concentration required in applying the wet material, could and often would result. Further, clean up of the applicator has always been difficult, time-consuming, disliked, and costly.

Obviously, what is needed in the art, and is not presently available, is an applicator for wet materials which can be used to apply a wet film of the desired uniform thickness on a workpiece, without resulting in any of the foregoing problems.

SUMMARY OF THE INVENTION

The instant invention fulfills the above-mentioned need, and thereby constitutes a significant advance in the state-of-the-art. It does so by providing a one-piece, reusable, simply structured applicator in the form of a cylindrical rod with circumferential protrusions which can be used efficiently, effectively, consistently, easily, and quickly to apply a uniform wet film of any wet material to the flat surface of a workpiece in a level position, and which said applicator thereafter can be cleaned rapidly and without difficulty.

Accordingly, it is an object of this invention to provide a wet film applicator which will consistently permit the application of a wet film of any wet material in a preselected uniform thickness on the surface of a workpiece.

It is another object of this invention to provide a simply structured wet film applicator which can be used easily and cleaned rapidly, and thereby is readily user-acceptable.

It is still another object of the instant invention to provide a wet film applicator, as described hereinabove, which is reusable after cleaning.

These objects of the instant invention, as well as other objects related thereto (such as ease and low cost of manufacture), will become readily apparent after a consideration of the description of the instant invention, together with reference to the Figures of the drawing.

DESCRIPTION OF THE DRAWING

FIG. 3 is a side view, in simplified pictorial form and partially in cross section, of the instant invention as seen along line 3—3 in FIG. 1; and FIG. 4 is a front view, in simplified pictorial form of another variation of the preferred embodiment which is shown in FIG. 1.

DESCRIPTION OF THE PREFERRED EMBODIMENT

Figure 1:
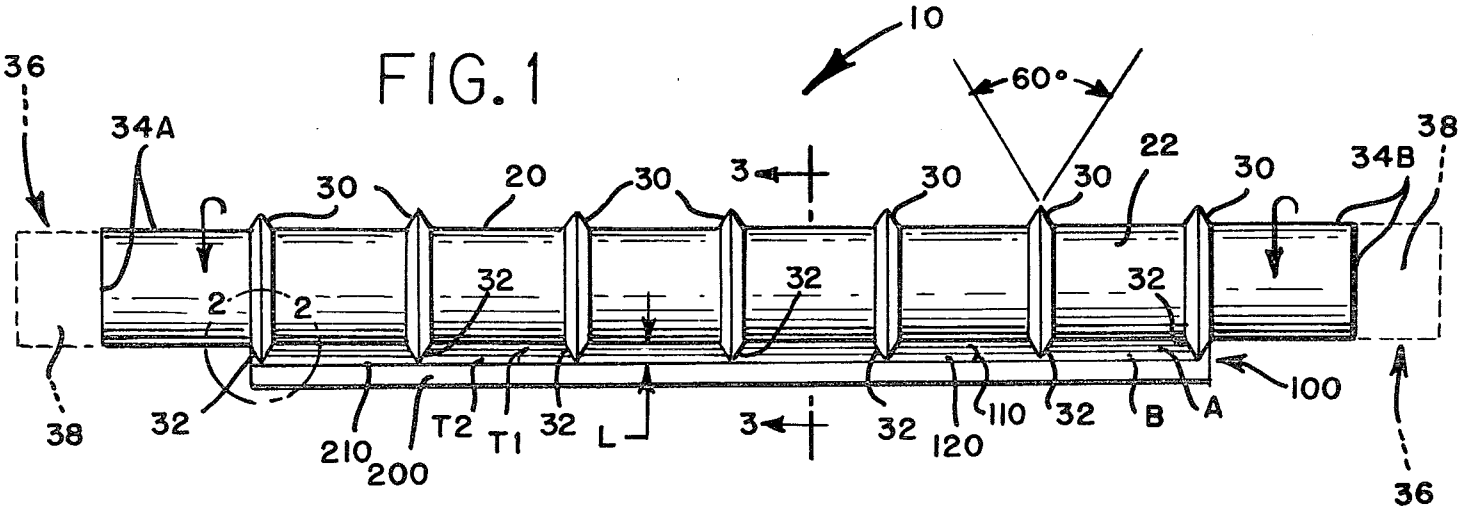
FIG. 1 is a front view, in simplified pictorial form, of the preferred embodiment of the instant invention, with a variation of said preferred embodiment being shown in phantom.

As a preliminary matter, and with reference to FIG. 1, it is to be noted and remembered that the instant invention is intended for use as an applicator in applying an initial wet film (such as is designated 110) of "wet" material (such as designated 100), where the "wet" material 100 (e.q., a semi-solid, or highly viscous material) matter which consists of a known X percentage in volume of an evaporable constituent A and of a known Y percentage in volume of a solid non-evaporable constituent B, and where X plus Y equal 100 percent. The wet film 110 is to be applied on the flat surface 210 of a workpiece 200 that is in a level position. The thickness T1 of the applied wet film 110 is preselected, and is to be uniform (i.e., equal) over the entire surface 210 of the workpiece 200. When the evaporable constituent A of the wet material 100 evaporates, the ultimate dry film 120 remaining is to be of a uniform predetermined thickness T2 of the non-evaporable constituent B.

Figure 2:
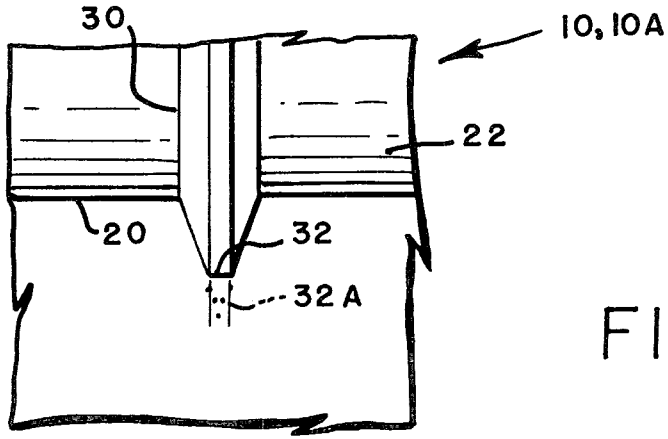
FIG. 2 is an enlarged view, in simplified pictorial form and not to scale, of the portion of the preferred embodiment encircled by circle 2—2 in FIG. 1, showing part of one of the protrusions extending from the circumferential surface of the cylindrical rod portion of the instant invention, and also showing in phantom a variation of the protrusion.

With reference to FIGS. 1–3, inclusive, the preferred embodiment 10 of the instant invention comprises, in the most basic generic structural form, a cylindrical rod 10 having a plurality of spaced-apart, annularly-shaped, protrusions 30 forming contact surfaces 32 with the wet material 100 and the surface 210 of the workpiece 200, with the protrusions 30 extending from the circumferential surface 22 of the rod 20 a length L equal to the preselected, uniform, thickness T1 of the applied initial wet film 110 of the wet material 100, such that when the wet material 100 dries, the ultimate dry film 120 remaining on the surface 210 of the workpiece 200 is of the predetermined, uniform, thickness T2, which is less than the thickness T1 of the initial wet film 110.

It is to be noted that if the top flat level surface 210 of the workpiece 200 is made of material which is relatively soft, as compared to the hardness of the material of which the applicator 10 is made, then in that event it is preferred that the contact surfaces 32 of the protrusions 30 of the applicator 10 be flat as is shown in FIG. 2. An example of such a situation is if the applicator 10 (and, of course, thereby its integral protrusions 30) is made of steel and the top flat level surface 210 of the workpeice is made of copper. However, when the surface 210 is made of material which is of equal or of greater hardness then the material of which the applicator 10 is made (such as where both are made of steel), then the contact surfaces 32 of the protrusions can be (but need not be) pointed, as is shown in phantom in FIG. 2 and is designated 32A.

As a matter of preference, the applicator 10 is made of tool steel. However, it can be made of any other durable material, and preferably of a material that can be "turned down" on a lathe.

As can be seen from FIG. 1, the applicator 10 has, as a matter of preference, two mutually opposed ends (or end portions) 34A and 34B by which it can be moved (i.e., pushed, pulled, or rotated) by any suitable means, such as means 36 shown in phantom in FIG. 1. The means 36 may include motors, such as are designated 38, or simply hands (not shown). In this regard, reference is made to FIG. 4 where a variation 10A of the applicator 10 is shown. In that Figure, the means 36 for moving the applicator 10A is a handle 38A. It is here to be noted that applicator variation 10A is used manually to push or pull the wet material, rather than to move the wet material by manually rotating the applicator 10A.

However, as a matter of preference, the applicator 10 is rotatable, as is shown in FIG. 1, in addition to being pushable and pullable, or in lieu of being pushable and pullable. If, in fact, the applicator 10 is solely rotatable, then means 36 for moving the ends 34A and 34B, and the motors 38 thereof, are motors which provide rotational motion. Of course, hands (not shown) may constitute the rotatable means 38.

It is also preferred that the cylindrical rod applicator (10 and 10A) be hollow, as is shown in FIG. 3, which is the view taken along line 3—3 in FIG. 1. However, the cylindrical rod applicator (10 and 10A) can be solid.

Further, it is preferred that the plurality of protrusions 30 be in equal, spaced-apart, relationship. Although only two protrusions (one near each end 34A and 34B) are needed, more than two (e.g., seven) are preferred, as are shown in FIGS. 1 and 4.

MANNER OF OPERATION OF THE PREFERRED EMBODIMENT

The manner of operation, and of use, of the preferred embodiment 10, FIGS. 1–3, inclusive, of the instant invention can be easily ascertained by any person of ordinary skill in the art from the foregoing description, coupled with reference to the contents of FIGS. 1–3, inclusive, of the drawing 14.

For others, the following explanation is given in conjunction with reference to FIG. 1, assuming that an initial wet film 110 of wet material 110 is to be applied with applicator 10 in a preselected uniform thickness wet thickness T1 on the top flat surface 210 of a workpiece 200 which is in a level position. Succinctly, the wet material 110 is placed on the surface 210 of the workpiece 200 (prefereably piled in front of the applicator 10), and the wet material 100 is pushed and/or pulled and/or rolled over with the applicator 10 manually until the wet material 100 covers the surface 210 in its entirety, and until the top surface of the wet film 110 is flush and level with the contacting circumferential surface 22 of the applicator 10, i.e., the length L of the protrusions 30 which equals the required thickness T1 of the initial wet film 110.

If, however, an applicator 10 of the necessary length L of the protrusions 30 is not available, then of course one can be easily made to meet that requirement from readily available commercial stocks of cylindrical rods.

Of course, it is assumed in all of the foregoing that the wet material 100 which is furnished to the user of the applicator 10 (or 10A, FIGS. 4, 2 and 3) comprises a composition of matter having the appropriate volumetric percentages of evaporable matter (i.e., solvent) constituent A, and of solid non-evaporable matter constituent B, such that with the use of the appropriately configured applicator 10 of 10A, the initial thickness T1 of the wet film 110 and the ultimate thickness T2 of the dry film 120 on the flat level surface 210 of the workpiece 200 can be attained.

CONCLUSION

It is abundantly clear from all of the foregoing, and from the contents of the Figures of the drawing, that the stated objects of the instant invention 10, as well as other objects related thereto, have been achieved.

It is to be noted that, although there has been described and shown the fundamental and unique features of the instant invention, as applied to a preferred embodiment 10, FIGS. 1–3, and a variation thereof 10A, FIGS. 4, 2 and 3, nevertheless various other embodiments, variations, adaptations, substitutions, additions, and the like may occur to and can be made by those of ordinary skill in the art. For example: (a) the applicator 10 and 10A can be held still and by suitable conventional means the workpiece 200 can be moved; (b) applicator variation 10A can be structured such that the ends 34C and 34D of the cylindrical rod 20A are rotatable within the ends of the handle 38A, so that the cylindrical rod 20A is rotatable; and (c) the applicator 10 and 10A can be used with a dry material, although structured for optimum use with a wet material.

What is claimed is:

1. An applicator used in applying a film of a uniform thickness of wet material on a flat surface being in a level position of a workpiece, said applicator comprising:

a metal cylindrical rod, the length of said rod being substantially greater than the diameter of said rod, a plurality of annularly-shaped protrusions extending from an external surface of said rod, said protrusions being positioned on said rod such that said uniform thickness of said wet material is applied, said protrusion extending from said rod a predetermined distance equal to about said uniform thickness, said protrusions being spaced apart by a substantial distance in comparision to said predetermined distance of said protrusions from said rod, and having a cross section of a truncated isosceles triangle having sides about 30 degrees from the vertical, said external surface of said rod between said protrusions applying said material in a uniformly thick and flat film on said workpiece, a handle for moving said applicator over said flat surface, and means for rotatably attaching said rod to said handle.

* * * * *